US006238191B1

(12) United States Patent
Strohl et al.

(10) Patent No.: US 6,238,191 B1
(45) Date of Patent: May 29, 2001

(54) APPARATUS FOR SUPPLYING A FUEL BY MEANS OF A FUEL SUPPLY UNIT ARRANGED IN A HOUSING

(75) Inventors: Willi Strohl, Beilstein; Dietmar Schmieder; Albert Gerhard, both of Markgroeningen; Jochen Rose, Hemmingen; Erich Eiler, Sersheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/354,558

(22) Filed: Jul. 15, 1999

(30) Foreign Application Priority Data

Jul. 21, 1998 (DE) ..... 198 32 8273

(51) Int. Cl.[7] ..... F04B 49/00

(52) U.S. Cl. ..... 417/299; 417/307; 417/435; 137/517

(58) Field of Search ..... 417/299, 307, 417/423.1, 435; 137/517, 539, 543.19, 540

(56) References Cited

U.S. PATENT DOCUMENTS

| | | | | |
|---|---|---|---|---|
| 3,395,853 | * | 8/1968 | Zoehfeld | 417/423.1 |
| 3,845,785 | * | 11/1974 | McMath | 137/517 |
| 4,205,947 | * | 6/1980 | Ruhl et al. | 417/435 |
| 5,348,442 | * | 9/1994 | Harris et al. | 415/55.1 |

FOREIGN PATENT DOCUMENTS

| | | | | |
|---|---|---|---|---|
| 500 426 | | 1/1971 | (CH) . | |
| 27 00 855 | | 7/1978 | (DE) . | |
| 33 44 339 A1 | | 7/1985 | (DE) . | |
| 35 40 260 A1 | | 5/1987 | (DE) | 137/517 |
| 2041448 | * | 9/1980 | (GB) | 417/423.1 |

* cited by examiner

*Primary Examiner*—Timothy S. Thorpe
*Assistant Examiner*—Cheryl J. Tyler
(74) *Attorney, Agent, or Firm*—Michael J. Striker

(57) ABSTRACT

The apparatus for supplying fuel includes a fuel tank and a fuel feed unit in the fuel tank. The fuel feed unit has a main housing, a suction cover arranged in a bottom part of the main housing, a fuel pump and a degassing valve arranged in the suction cover for degassing the fuel pump. The fuel pump itself includes an impeller housing with a circular passage for fuel flow and an electric-motor-driven impeller. The impeller housing is arranged in the main housing and next to the suction cover and it is provided with a degassing passage connecting the circular passage with the degassing valve. To improve starting behavior the fuel feed unit has a degassing valve in the suction cover, which is connected with the circular passage of the impeller housing by a degassing passage. The degassing valve opens to the fuel tank when pressure in the degassing passage exceeds a predetermined value for degassing the fuel pump. The degassing valve can be a spring-loaded ball valve in which the compression spring bearing on the ball provides a predetermined counter-force so that the degassing valve is kept open during idle and start of impeller rotation until degassing is complete.

8 Claims, 2 Drawing Sheets

APPARATUS FOR SUPPLYING A FUEL BY MEANS OF A FUEL SUPPLY UNIT ARRANGED IN A HOUSING

BACKGROUND OF THE INVENTION

1. Field of the Invention

The present invention relates to an apparatus for supplying fuel by means of a fuel supply unit provided with a main housing and accommodated in a fuel tank, which has a fuel pump for an initial fuel flow, a degassing valve and a suction cover arranged at the bottom of the main housing. The fuel pump has an impeller arranged in an impeller housing with a circular passage.

2. Prior Art

An apparatus of this type is known from German Patent Document DE 35 40 260 A1. The known apparatus has a fuel supply unit in a main housing. This sort of fuel supply unit is usually located in a fuel tank, in order to feed fuel from the tank, for example to an internal combustion engine, through an outlet connector of the fuel supply unit by means of a pump intake. Also the pump intake is arranged in a suction cover, which is located in the bottom region of the main housing and the outlet connector is generally arranged beside a degassing valve in the top cover of the main housing. The fuel pump has an electrical drive unit, whose stator and rotor are arranged in the central region of the housing and a pump unit comprising an impeller arranged in an impeller housing is introduced to the lower region of the main housing. The impeller produces suction or low pressure in a circular passage, whereby the fuel is fed.

The degassing valve, which is arranged in an upper region of the main housing, is combined with an overpressure valve in the apparatus for feeding fuel described in German Patent Document DE 35 40 260 A1. The degassing valve thus performs two functions, namely first to remove gas bubbles from the main housing formed by heating of the pump and the impeller and second to permit partial return flow of fuel to the fuel tank when an overpressure exists in the main housing. This type of structure has the disadvantage that gas bubbles are not immediately removed from the region in which they are produced, i.e. in the active region of the fuel pump. These gas bubbles must collect in the upper region of the main housing after the pump runs before they can be released through the degassing valve. Because of that feature the conventional pump has a reduced performance in the starting stage, primarily because the gas collected in the impeller region must first be supplied through the circular passage and then through the entire volume of the main housing to the degassing-overpressure valve before the fuel becomes incompressible during the fuel supply process. That means that the apparatus equipped with a combined degassing-overpressure valve according to German Patent Document DE 35 40 260 A1 has a substantially reduced suction head in its starting stage in comparison to its main operating stage.

SUMMARY OF THE INVENTION

It is an object of the present invention to provide an apparatus which has improved pumping characteristics in the hot feed stage, in the hot start stage, in the cold feed stage and in the cold start stage and reduced pumping losses, that are caused by the conventional degassing-overpressure valve.

According to the invention this object is attained by an apparatus for supplying fuel comprising a fuel tank and a fuel feed unit arranged in the fuel tank. The fuel feed unit comprises a main housing, a suction cover arranged in a bottom region of the main housing, a fuel pump and a degassing valve for degassing the fuel pump arranged in the suction cover. The fuel pump comprises an impeller housing having a circular passage for fuel flow and an impeller arranged in the impeller housing. The impeller housing is arranged next to the suction cover and provided with a degassing passage connecting the circular passage and the degassing valve. The degassing valve opens to the fuel tank preferably when pressure in the degassing passage exceeds a predetermined value for degassing the fuel pump.

Because the degassing valve is arranged in a bottom region of the main housing of the fuel feed unit, namely in the suction cover of the fuel feed unit and because the degassing valve is connected with the circular passage of the impeller housing by means of a degassing passage in the lower region of the main housing of the fuel fed unit, degassing of the gas bubbles occurs in the immediate vicinity of the source of the gas bubbles, i.e. in the vicinity of the active pump parts, especially the impeller and the circular passage. Because of that aspect of the invention the performance loss, which is caused by degassing, is reduced by the proximity to the degassing means, which has an extremely positive effect on the starting stage.

In a particularly preferred embodiment of the invention the degassing valve includes a valve seat, a valve ball, a compression spring and guide ribs for guiding the valve ball in a valve body. When the degassing valve is open, the guide ribs keep a degassing passage around the valve ball open. Furthermore the guide ribs guide the valve ball from a first open position to a second closed position on the valve seat in such a way that the valve ball is centered and completely sealed in the second position in which the degassing valve is closed to provide a medium tight seal.

As long as gas bubbles are located in the impeller region and in the circular passage, the valve ball remains in its first position because of the pressure exerted by the compression spring and thus the degassing valve remains open. As soon as a suitable feed pressure is built up in the circular passage by a bubble free fuel, this pressure is transmitted through the degassing passage to the valve ball through the degassing passage, the counter pressure exerted by the compression spring is exceeded and the degassing valve is closed in its second position with a medium tight seal. From this point in time onward the complete feed pressure both in the cold feed stage and also in the hot feed stage is available. This entire feed characteristic of this preferred embodiment of the invention is improved in comparison to that of the conventional fuel feed unit.

In another preferred embodiment the degassing valve is kept open by a spring tension in the compression spring when the fuel pump is idle and when the impeller is started until completely degassed, so that when the medium supplied, in this case fuel, becomes completely incompressible, the overpressure produced in the circular passage acts on the valve ball through the degassing passage and forces it to the valve seat. Because of that action the valve ball is pressed on the valve seat and the degassing valve is completely shut terminating the degassing.

In a preferred embodiment the valve body of the degassing valve is an integral part of the suction cover. In this embodiment the valve body is directly die cast with the suction cover, so that processing costs and manufacturing costs is are reduced. In an additional preferred embodiment of the invention the guide ribs are formed as an integral part of the suction cover. Because of this aspect of the invention further simplifications are attained which are especially effective in mass production.

Furthermore the valve seat can be formed on a fitting piece for a cavity in the suction cover. The fitting piece can be engaged in a press fit or in a force-locking manner in the cavity in the suction cover. Because of this feature the valve seat, which requires a higher precision in manufacturing, is made separately from the die cast suction cover. As soon as the fitting piece is fabricated, it can be forced in a force-locking connection in a suitable previously prepared recess or cavity, which is provided in the suction cover for the degassing valve. It is however also conceivable that the valve seat can be formed on a threaded insert for the suction cover and the suction cover can be provided with a threaded passage in which the threaded insert is engaged by screwing with a seal. In this embodiment of course a greater expense is required because it is necessary to provide an O-ring or a flat seal and a suitable seal seat for the fitting piece which has the valve seat. On the other hand, it provides an outstanding seal between the fuel in the fuel tank and the fuel in the circular passage of the fuel pump. A seal of this type, which is attained at the instant, when the valve ball is pressed firmly on the valve seat by the fuel feed pressure, has the advantage that the leakage loss can be kept extremely small so that the maximum feed performance of the fuel feed unit is available.

In an additional preferred embodiment the fitting piece has a guiding projecting portion reduced in its radius relative to the remaining portion for the compression spring. The projecting portion of the fitting piece is pipe-like and has the valve seat on its upper end. This sort of embodiment has the advantage that the guiding function of the guide ribs is assisted by the projecting portion in order to center the valve ball on the valve seat with the degassing valve closed.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENT

Figure 1:
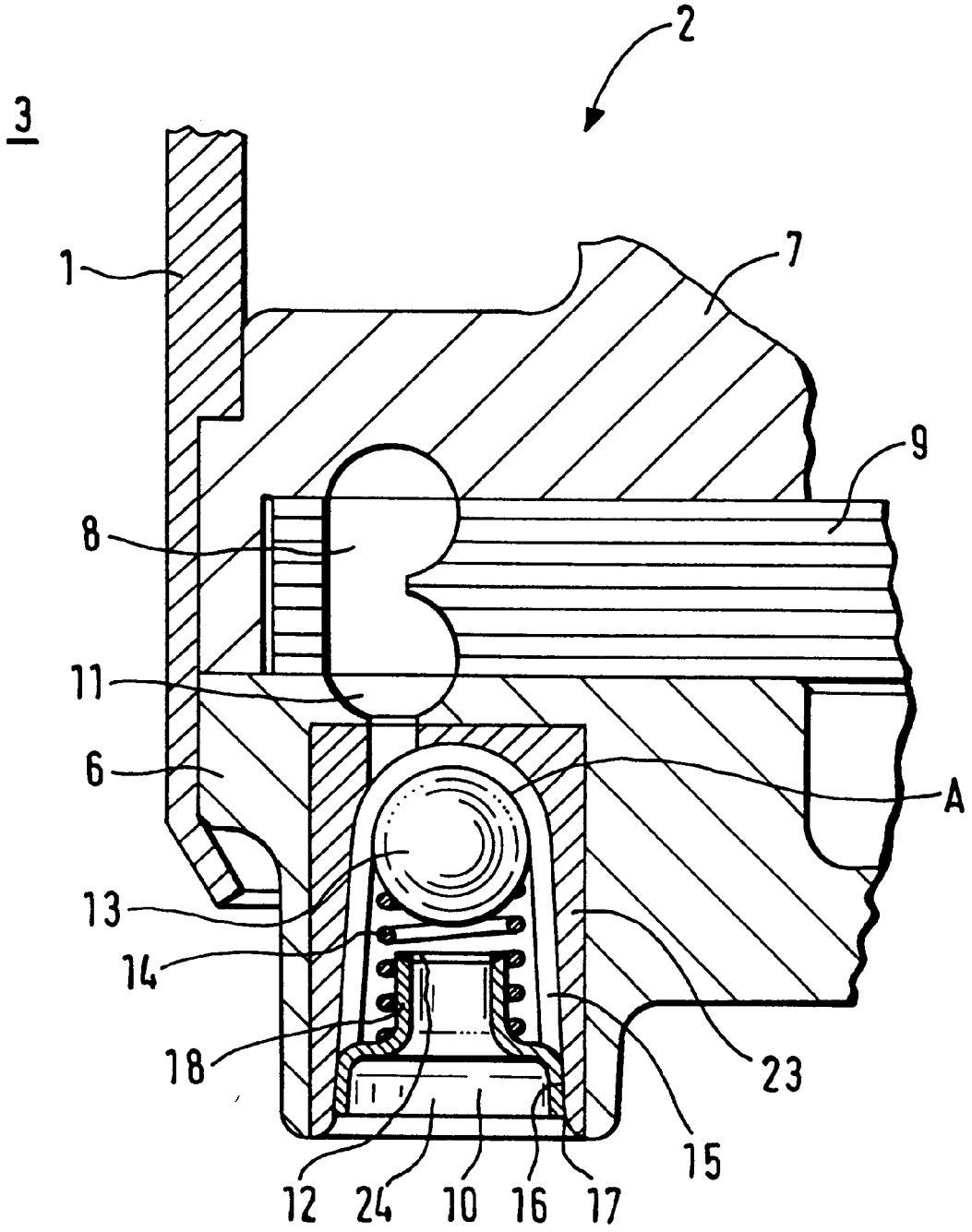
FIG. 1 is a cutaway cross-sectional view of a fuel feed unit according to the invention with a degassing valve in a bottom suction cover.
Figure 2:
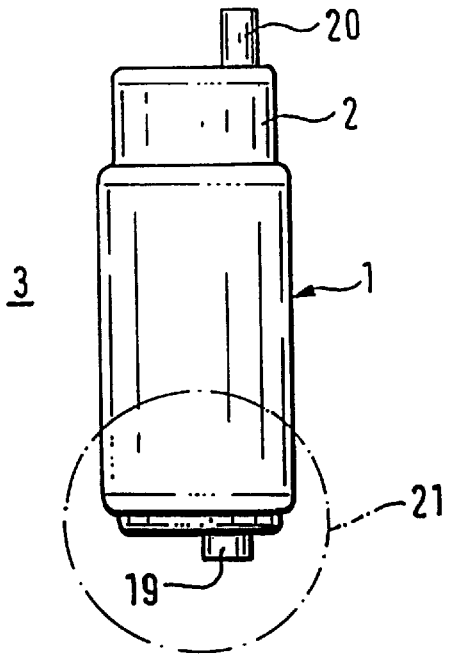
FIG. 2 is a side view of a fuel feed unit.
Figure 3:
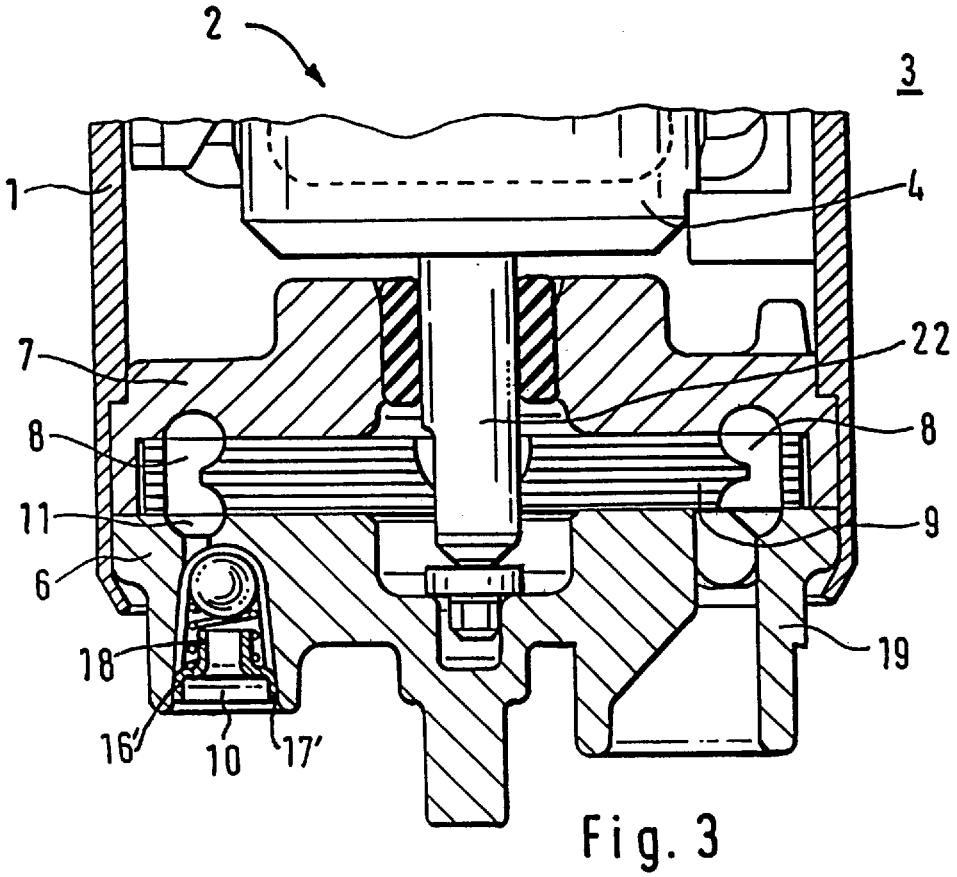
FIG. 3 is a cutaway cross-sectional view of the entire bottom region of a fuel feed unit according to the invention.

FIG. 1 shows a cross-section of a fuel feed unit 2, which is a device to feed fuel usually arranged in a fuel tank 3. The fuel is drawn in through a suction connector 19 as shown in FIG. 3 and is fed by means of an electrical fuel pump 4 into a fuel line through an outlet connector 20 (outlet connector 20 is shown in FIG. 2). The electrical fuel pump is accommodated in the main housing 1 of the fuel feed unit 2. This sort of fuel feed unit with an electrical fuel pump is usually arranged in a fuel tank and surrounded by fuel. The suction connector 19 is located in a bottom or lower region 21 of the fuel feed unit and the outlet connector 20 is arranged in an upper or top region of the fuel feed unit 2.

FIG. 3 shows a cross-section through the entire bottom region of the fuel feed unit 2. An impeller housing 7 is provided for the active pump parts in the bottom region 21 of the fuel feed unit 2, which receives the impeller 9 and is provided with a circular duct or passage 8. The highest feed pressure is produced in this circular passage 8 by driving the impeller by means of a motor shaft 22.

A gas cushion arises on starting and after shutting the pump off in this pump region of the fuel feed unit 2 by heating and by a high turbulence in the circular passage. This sort of gas cushion is compressible and reduces the performance or efficiency of the fuel pump. When the active region of the fuel pump is degassed, the complete performance can be expected. In order to make this possible without starting losses, in the preferred embodiment in FIG. 1 the degassing valve 10 is arranged in the suction cover 6 at the bottom of the fuel feed unit 2 in the immediate vicinity of the circular passage 8 of the impeller housing 7. Since the degassing gas valve 10 is connected with the circular passage 8 by the degassing passage 11, the gas cushion collecting in the circular passage or fed into the circular passage 8 by the impeller 9 can be forced out from the fuel feed unit 2 through the degassing valve 10 and through the degassing passage 11 in a comparatively short initial stage.

Accordingly degassing valve 10, as shown in FIG. 1, comprises a valve body 23 made of brass and a valve ball 13 made of brass and is installed at a suitable location in the suction cover 6 of the electrical fuel pump.

An improved suction head was obtained with this sort of pump. The maximum spacing between the liquid level in the fuel tank and the lower edge of the suction connector 19 in the suction cover 6 is defined as the suction head, which the pump is in a position to supply. This pump with the degassing valve shown in FIG. 1 has a substantially improved suction head in comparison the typical prior art pump after a second after starting. The valve has guide ribs 15 in its valve body 23, which guide the valve ball 13 in the valve body 23, which acts as a valve housing, between a first open position and a second closed position. A valve ball 13 is held in its open position by means of a compression spring 14 until the pressure in the circular passage is high enough so that it urges the valve ball 13 toward the valve seat 12 against the spring force via the degassing passage 11. The guide ribs in the vicinity of the degassing passage also have the purpose of preventing the closing of the degassing passage 11 by the valve ball 13, since they hold the valve ball 13 at a definite predetermined distance from the opening of the degassing passage 11, when the pressure in the degassing passage is not great enough to overcome the spring force.

The valve seat itself is arranged in the embodiment according to FIG. 1 on a pipe-like projecting portion 18, which simultaneously acts to guide the compression spring 14 along its outer wall. The pipe-like projecting portion is part of a fitting piece 16 that is wider than the projecting portion 18. The fitting piece 16 is pressed into a cavity 17 in the valve body 23 of the degassing valve 10 in force-locking manner with a medium-tight seal. As soon as the valve ball 13 is pressed on the valve seat 12 by the feed pressure, the pump is completely closed with the medium-tight seal and the performance is not reduced by any leakage. In an alternative embodiment indicated in FIG. 3 the projecting portion 18 is part of a threaded insert 16' that is screwed into a threaded cavity 17' in the valve body 23.

In the vertical structural configuration shown in FIG. 1 the degassing valve switches at a flow of about 20 l/Std., i.e. when the electrical motor has reached about 1000 rpm. At this rotation speed the pump voltage is 3.8 V, so that the valve definitely has advantageous feed characteristics, especially at low voltage, for a pump with a degassing valve in the suction cover. Also no losses occur because a degassing passage is provided in the conventional structure. The hot flow behavior of this sort of fuel feed unit 2 is comparable with a series pump, however the hot start behavior is substantially improved in relation to this type of series pump.

After a short starting time interval of about a second, a fuel feed unit 2 according to the invention with the degassing valve 10 is considerably improved in comparison to the conventional pump. The valve does not change the suction properties of the pump portion, but permits rapid removal of the air generated in the pump chamber. A conventional pump without the degassing valve can achieve a similar suction head, when the arising air of the gas-air mixture is removed by an unintended leak in the vicinity of the suction cover.

The suction head difference between a fuel feed unit 2 according to the invention and a conventional fuel pump results partially from the negative influence of a serially constructed degassing passage as well as the degassing passage for the degassing valve. The conventional arrangement of a degassing passage in front part of the main passages in this type of pump considerably reduces the pump performance. A pump part without any degassing passage has a somewhat improved efficiency only at small rotation speed when the electrical motor is in the lower voltage range. However the device according to the invention provides a fuel feed unit, which achieves an optimum feed performance in the entire rotational speed range of the feed pump.

The disclosure in German Patent Application 198 32 827.3-13 of Jul. 21, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an apparatus for supplying a fuel by means of a fuel supply unit arranged in a housing, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. An apparatus for supplying fuel, said apparatus comprising a fuel tank (3) and a fuel feed unit (2) arranged in the fuel tank, said fuel feed unit (2) comprising a main housing (1), a suction cover (6) arranged in a bottom region of the main housing, a fuel pump and a degassing valve (10) arranged in the suction cover (6), said degassing valve (10) including means for degassing said fuel pump;

wherein the fuel pump comprises an impeller housing (7) having a circular passage (8) for fuel flow and an impeller (9) arranged in the impeller housing (7), said impeller housing (7) is arranged in the main housing (1) and next to said suction cover(6), and said impeller housing (7) is provided with a degassing passage (11) connecting the circular passage (8) and the degassing valve (10); and wherein the degassing valve (10) includes a valve body (23), a valve seat (12) in the valve body, a valve ball (13) in the valve body, a compression spring (14) arranged in the valve body so as to bear on the valve ball (13) and guide ribs (15) for guiding said valve ball in the valve body and for spacing said valve ball from an opening of said degassing passage (11), so that the valve ball (13) is urged into a first position (A) in the direction of the degassing passage (11) from the valve seat (12) by means of the compression spring (14) when pressure in said degassing passage (11) does not exceed a predetermined value and the valve ball (13) is forced into a second position on the valve seat (12) with said compression spring (14) pressed together in operation when said pressure in said degassing passage (11) exceeds a predetermined value.

2. The apparatus as defined in claim 1, wherein the degassing valve (10) is kept open during idle and start of rotation of the impeller (9) until degassing is complete by providing a predetermined pre-tensioning of the compression spring (14).

3. The apparatus as defined in claim 2, wherein the valve ball (13) is pressed on the valve seat (12) so that the degassing valve (10) is closed and the degassing is terminated according to said pre-tensioning.

4. The apparatus as defined in claim 1, wherein said valve body (23) of the degassing valve (10) is an integral part of the suction cover (6).

5. The apparatus as defined in claim 1, wherein said guide ribs (15) are integral parts of said suction cover (6).

6. The apparatus as defined in claim 1, wherein said valve seat (12) is provided on a fitting piece (16) formed to fit a cavity (17) provided in the suction cover (6) and the fitting piece (16) is held in a force-locking connection in the cavity (17).

7. The apparatus as defined in claim 6, wherein the fitting piece (16) has a projecting portion (18) on which the valve seat (12) is provided and the projecting portion (18) guides and supports the compression spring (14).

8. The apparatus as defined in claim 1, wherein said valve seat (12) is provided on a threaded insert (16') for the suction cover (12), the threaded insert (16') has a projecting portion (18) on which the valve seat (12) is provided and the suction cover (6) is provided with a threaded cavity (17') in which the threaded insert (16') is engaged and sealed.

* * * * *